US007659804B2

(12) United States Patent
Harris et al.

(10) Patent No.: US 7,659,804 B2
(45) Date of Patent: Feb. 9, 2010

(54) HIGH VOLTAGE/HIGH CURRENT FUSE

(75) Inventors: Edwin J. Harris, Oak Park, IL (US); Jeffrey J. Ribordy, Lake Zurich, IL (US); William P. Brown, Rolling Meadows, IL (US); John Adamczyk, Schaumburg, IL (US); Douglas Fischer, Addison, IL (US); Gregory Stumpo, Schaumburg, IL (US)

(73) Assignee: Littelfuse, Inc., Chicago, IL (US)

( * ) Notice: Subject to any disclaimer, the term of this patent is extended or adjusted under 35 U.S.C. 154(b) by 254 days.

(21) Appl. No.: 11/228,688

(22) Filed: Sep. 15, 2005

(65) Prior Publication Data

US 2006/0055497 A1 Mar. 16, 2006

Related U.S. Application Data

(60) Provisional application No. 60/610,401, filed on Sep. 15, 2004.

(51) Int. Cl.
*H01H 85/04* (2006.01)
*H01H 85/02* (2006.01)
*H01H 85/18* (2006.01)

(52) U.S. Cl. ..... 337/159; 337/186; 337/234; 337/190; 337/227; 337/276; 337/158

(58) Field of Classification Search ..... 337/33, 337/142, 145, 150, 157–159, 170, 177, 181, 337/208, 222, 227–231, 34, 260–262, 166, 337/186, 273, 255, 161–162, 176, 190, 234, 337/276, 158; 439/622, 893; 29/623
See application file for complete search history.

(56) References Cited

U.S. PATENT DOCUMENTS 480,802 A 8/1892 Blathy (Continued)

FOREIGN PATENT DOCUMENTS

AU 526 077 B2 12/1982

(Continued)

OTHER PUBLICATIONS

International Search Report for corresponding International Application No. PCT/US05/33595, dated Jun. 6, 2007, 3 pages.

(Continued)

*Primary Examiner*—Jayprakash N Gandhi
*Assistant Examiner*—Bradley H Thomas
(74) *Attorney, Agent, or Firm*—Duane Morris

(57) ABSTRACT

A fuse for a high voltage/high current application, such as a hydro-electric vehicle ("HEV") application is provided. The fuse employs a variety of arc quenching features to handle a large amount of arcing energy that is generated when such fuse is opened due to a fuse opening event. In one embodiment, an insulative substrate, such as a melamine substrate, is metallized with a fuse element. The fuse element extends to multiple surfaces of the substrate. A fuse opening portion of the element is located so that the arcing energy is forced to travel along multiple insulative planes, increasing an impedance across the opening of the element and decreasing the likelihood of a sustained arc. Also, the substrate and element are disposed in a sealed housing, which is packed in one embodiment with an arc quenching material, such as sand.

29 Claims, 10 Drawing Sheets

U.S. PATENT DOCUMENTS

| | | | | | |
|---|---|---|---|---|---|
| 1,687,247 | A | * | 10/1928 | Hickey | 337/252 |
| 1,700,582 | A | | 1/1929 | Brown | |
| 1,858,245 | A | * | 5/1932 | La Mar | 337/235 |
| 2,198,663 | A | * | 4/1940 | Floten | 337/233 |
| 2,243,741 | A | * | 5/1941 | Rowe | 439/833 |
| 2,245,346 | A | | 6/1941 | Klein | |
| 2,497,227 | A | * | 2/1950 | Messer et al. | 337/233 |
| 2,794,097 | A | | 5/1957 | Jacobs, Jr. | |
| 3,041,428 | A | * | 6/1962 | Sommers | 337/238 |
| 3,599,174 | A | * | 8/1971 | Dhaliwal | 439/166 |
| 3,654,696 | A | * | 4/1972 | Wechsler et al. | 29/623 |
| 3,775,723 | A | | 11/1973 | Mamrick et al. | |
| 3,909,767 | A | | 9/1975 | Williamson et al. | |
| 3,997,862 | A | | 12/1976 | Kozacka et al. | |
| 4,008,451 | A | | 2/1977 | Salzer | |
| 4,008,452 | A | | 2/1977 | Cameron | |
| 4,010,438 | A | | 3/1977 | Scherer | |
| 4,023,265 | A | | 5/1977 | Aryamane | |
| 4,028,656 | A | | 6/1977 | Schmunk et al. | |
| 4,045,758 | A | | 8/1977 | Biller et al. | |
| 4,057,775 | A | | 11/1977 | Biller | |
| 4,060,785 | A | | 11/1977 | Hanke et al. | |
| 4,071,837 | A | | 1/1978 | Ranzanigo | |
| 4,075,755 | A | | 2/1978 | Bernatt et al. | |
| 4,103,270 | A | | 7/1978 | Jackson, Jr. | |
| 4,109,227 | A | | 8/1978 | Biller et al. | |
| 4,123,738 | A | | 10/1978 | Huber | |
| 4,131,869 | A | | 12/1978 | Schmidt, Jr. et al. | |
| 4,153,893 | A | | 5/1979 | Swanson | |
| 4,159,185 | A | | 6/1979 | Scherer et al. | |
| D254,487 | S | | 3/1980 | Biller et al. | |
| D254,545 | S | | 3/1980 | Evans et al. | |
| 4,192,534 | A | | 3/1980 | Bernatt et al. | |
| D254,614 | S | | 4/1980 | Biller et al. | |
| D254,615 | S | | 4/1980 | Evans et al. | |
| D254,668 | S | | 4/1980 | Chabala | |
| 4,198,615 | A | | 4/1980 | Mahieu | |
| 4,205,295 | A | | 5/1980 | Mahieu | |
| 4,216,457 | A | * | 8/1980 | Panaro | 337/160 |
| 4,220,375 | A | | 9/1980 | Burgdorf et al. | |
| 4,220,940 | A | | 9/1980 | Huber | |
| 4,224,592 | A | | 9/1980 | Urani et al. | |
| 4,272,751 | A | | 6/1981 | Biller et al. | |
| 4,275,431 | A | | 6/1981 | Swoish et al. | |
| 4,307,369 | A | | 12/1981 | Jackson, Jr. | |
| 4,308,515 | A | * | 12/1981 | Rooney et al. | 337/162 |
| 4,320,375 | A | | 3/1982 | Lien | |
| 4,320,432 | A | | 3/1982 | Duenke | |
| 4,343,978 | A | | 8/1982 | Kubiatowicz | |
| 4,344,059 | A | | 8/1982 | Swanson | |
| 4,357,588 | A | | 11/1982 | Leach et al. | |
| 4,394,639 | A | * | 7/1983 | McGalliard | 337/292 |
| 4,419,651 | A | | 12/1983 | Leach | |
| 4,486,734 | A | | 12/1984 | Leach | |
| 4,489,301 | A | | 12/1984 | Johnson et al. | |
| 4,503,415 | A | * | 3/1985 | Rooney et al. | 337/160 |
| 4,523,172 | A | | 6/1985 | Drothen et al. | |
| 4,536,735 | A | | 8/1985 | van der Scheer | |
| 4,542,364 | A | | 9/1985 | van der Scheer | |
| 4,544,907 | A | | 10/1985 | Takano | |
| 4,563,666 | A | * | 1/1986 | Borzoni | 337/252 |
| 4,570,146 | A | | 2/1986 | Huber et al. | |
| 4,570,147 | A | | 2/1986 | Ebi | |
| 4,580,124 | A | | 4/1986 | Borzoni | |
| 4,604,602 | A | | 8/1986 | Borzoni | |
| 4,608,548 | A | | 8/1986 | Borzoni | |
| 4,617,544 | A | | 10/1986 | Mooz et al. | |
| 4,630,022 | A | | 12/1986 | Yuza | |
| 4,635,023 | A | | 1/1987 | Oh | |
| 4,646,053 | A | | 2/1987 | Mosesian | |
| 4,661,793 | A | | 4/1987 | Borzoni | |
| 4,672,352 | A | | 6/1987 | Takano | |
| 4,703,299 | A | | 10/1987 | Vermij | |
| 4,837,546 | A | * | 6/1989 | Bernstein | 337/272 |
| 4,869,972 | A | | 9/1989 | Hatagishi | |
| 4,870,386 | A | | 9/1989 | Arikawa | |
| 4,871,990 | A | | 10/1989 | Ikeda et al. | |
| 4,894,633 | A | | 1/1990 | Holtfreter | |
| 4,899,123 | A | | 2/1990 | Asdollahi et al. | |
| 4,949,062 | A | * | 8/1990 | Mollet | 337/248 |
| 4,972,170 | A | * | 11/1990 | Ehlmann et al. | 337/228 |
| 4,997,393 | A | | 3/1991 | Armando | |
| 4,998,086 | A | | 3/1991 | Kourinsky et al. | |
| 5,055,817 | A | * | 10/1991 | O'Shields et al. | 337/161 |
| 5,091,712 | A | * | 2/1992 | Suuronen | 337/297 |
| 5,095,297 | A | * | 3/1992 | Perreault et al. | 337/297 |
| 5,101,187 | A | | 3/1992 | Yuza | |
| 5,109,211 | A | | 4/1992 | Huber | |
| 5,115,220 | A | * | 5/1992 | Suuronen et al. | 337/297 |
| 5,130,688 | A | | 7/1992 | Van Rietschoten et al. | |
| 5,139,443 | A | | 8/1992 | Armando | |
| 5,148,141 | A | * | 9/1992 | Suuronen | 337/297 |
| 5,153,553 | A | | 10/1992 | Ruehl et al. | |
| 5,229,739 | A | | 7/1993 | Oh et al. | |
| 5,293,147 | A | | 3/1994 | Oh et al. | |
| 5,296,833 | A | | 3/1994 | Breen et al. | |
| 5,300,913 | A | * | 4/1994 | Linton | 337/242 |
| 5,345,210 | A | * | 9/1994 | Swensen et al. | 337/163 |
| 5,357,234 | A | * | 10/1994 | Pimpis et al. | 337/246 |
| 5,426,411 | A | * | 6/1995 | Pimpis et al. | 337/186 |
| 5,446,436 | A | | 8/1995 | Williams | |
| 5,479,147 | A | | 12/1995 | Montgomery | |
| 5,581,225 | A | | 12/1996 | Oh et al. | |
| 5,592,139 | A | | 1/1997 | Trayer et al. | |
| 5,594,403 | A | | 1/1997 | Taga et al. | |
| 5,604,474 | A | | 2/1997 | Leach et al. | |
| 5,631,620 | A | | 5/1997 | Totsuka et al. | |
| 5,663,861 | A | | 9/1997 | Reddy et al. | |
| 5,668,521 | A | | 9/1997 | Oh | |
| 5,670,926 | A | | 9/1997 | Ranjan et al. | |
| 5,714,923 | A | | 2/1998 | Shea et al. | |
| 5,736,918 | A | * | 4/1998 | Douglass | 337/186 |
| 5,783,987 | A | | 7/1998 | Kern et al. | |
| 5,812,046 | A | * | 9/1998 | Brown et al. | 337/290 |
| 5,854,583 | A | * | 12/1998 | Falchetti | 337/290 |
| 5,880,664 | A | | 3/1999 | Hollmann et al. | |
| 5,886,327 | A | | 3/1999 | Lee | |
| 5,892,427 | A | | 4/1999 | Handcock | |
| 5,905,426 | A | * | 5/1999 | Douglass | 337/229 |
| 5,923,515 | A | * | 7/1999 | Eubanks et al. | 361/104 |
| 5,963,123 | A | * | 10/1999 | Douglass | 337/254 |
| 6,067,004 | A | | 5/2000 | Hibayashi et al. | |
| 6,147,585 | A | * | 11/2000 | Kalra et al. | 337/248 |
| 6,275,135 | B1 | * | 8/2001 | Hibayashi et al. | 337/227 |
| 6,294,978 | B1 | | 9/2001 | Endo et al. | |
| 6,384,708 | B1 | * | 5/2002 | Jollenbeck et al. | 337/297 |
| 6,403,145 | B1 | | 6/2002 | Montgomery | |
| 6,420,217 | B1 | | 7/2002 | Kalnitsky et al. | |
| 6,448,882 | B1 | * | 9/2002 | Inaba et al. | 337/227 |
| 6,486,766 | B1 | * | 11/2002 | Reid et al. | 337/186 |
| 6,496,096 | B2 | | 12/2002 | Kondo et al. | |
| 6,501,634 | B1 | | 12/2002 | Hubbell | |
| 6,525,397 | B1 | | 2/2003 | Kalnitsky et al. | |
| 6,538,550 | B1 | | 3/2003 | Muench, Jr. et al. | |
| 6,556,119 | B1 | | 4/2003 | Lell | |
| 6,590,490 | B2 | * | 7/2003 | Ackermann | 337/290 |
| 6,614,340 | B2 | | 9/2003 | Handcock et al. | |
| 6,642,833 | B2 | | 11/2003 | Ranjan et al. | |
| 6,686,791 | B2 | | 2/2004 | Zheng et al. | |
| 6,693,481 | B1 | | 2/2004 | Zheng | |
| 6,720,857 | B2 | | 4/2004 | Borchardt et al. | |
| 6,903,598 | B2 | | 6/2005 | Denham et al. | |
| 2005/0040927 | A1 | * | 2/2005 | Umeda | 337/273 |

2006/0214259 A1 * 9/2006 Spaunhorst ..... 257/529

FOREIGN PATENT DOCUMENTS

| | | | |
|---|---|---|---|
| DK | 27 14 797 | A1 | 2/1979 |
| EP | 0 285 489 | A1 | 10/1988 |
| EP | 0 802 553 | A2 | 10/1997 |
| EP | 0 939 417 | A1 | 9/1999 |
| GB | 2 113 489 | A | 8/1983 |
| GB | 2 233 512 | A | 1/1991 |
| JP | 6-48149 | | 6/1994 |
| JP | 10-241546 | | 9/1998 |

OTHER PUBLICATIONS

Supplementary European Search Report for European Application No. EP 05 80 9836 dated Sep. 23, 2008.

* cited by examiner

HIGH VOLTAGE/HIGH CURRENT FUSE

CROSS REFERENCE TO RELATED APPLICATIONS

This patent claims the priority benefit under 35 U.S.C. §119(e) of U.S. Provisional Application Ser. No. 60/610,401, filed on Sep. 15, 2004, titled "HIGH VOLTAGE/HIGH CURRENT FUSE", the contents of this provisional application are hereby incorporated herein by reference in its entirety for all purposes.

BACKGROUND

The invention relates generally to circuit protection and more specifically fuse protection.

Hybrid-electric vehicle ("HEV") development is becoming more prevalent in automotive development and important to users of fuses. HEV systems use much higher voltages and currents than do typical automotive systems. System bus voltages for HEV systems can be in the range of 600 volts DC or AC and 300 amps.

High voltage applications require a fuse element that can handle the energy and arcing associated with an opening of the element of the fuse or circuit. While fuses exist for high voltage and high current applications, it is believed that a need exists for an improved high voltage/current fuse in particular for HEV systems. Such improved fuse needs to have improved energy handling and arc quenching characteristics and be provided in a relatively small package, suitable for the automotive environment.

The fuse also needs to be sturdy enough to be fastened securely within a rugged type of application, such as an automotive or HEV application. Also, a relatively low cost and ease of assembly are always desirable for an original equipment manufacturer ("OEM") item, especially in the automotive industry. A need therefore exists for an improved fuse according to the parameters highlighted above.

SUMMARY

The present invention provides an improved fuse, which may be used in automotive applications and in particular may be used in a hybrid-electric vehicle ("HEV") applications. While HEV applications are contemplated, the fuse of the present invention is operable in any application operating around or below 600 volts DC or AC and 300 amps of current. The fuse employs a number of features that help quench arcing due to the opening of a fuse protecting such a circuit. One feature includes separating the fuse element onto different planes of an insulative substrate. The separated fuse element portions communicate electrically through one or more vias or apertures provided in the substrate.

In one embodiment, the fuse element extends from a first termination end of the substrate inwards toward a middle portion of the substrate. At the middle portion of the substrate the element extends through one or more via or aperture to an opposite side of the substrate. On that opposite side of the substrate, the fuse element extends to an opposing second termination end of the substrate.

The fuse element is (i) thinned, (ii) reduced in cross-sectional area and/or (iii) metallized with a second conductive material that is likely to diffuse into the element material at a desired point or location for the fuse element to open. In one embodiment, that fuse opening point or location occurs near the aperture through the substrate separating the fuse element portions. In such configuration, arcing energy has to (i) travel along one plane, (ii) move orthogonally through the aperture or via in the substrate to a second plane located on the opposite side of the substrate and (iii) travel along the second plane. Dividing the arcing path into multiple planes is believed to provide desirable arc quenching characteristics. In another embodiment the aperture or via is filled with an arc quenching room temperature vulcanizing ("RTV") material, such as silicone to further aid in quenching the arc.

In another arc quenching feature, the fuse element is disposed within a sealed housing. The sealed housing is loaded or impregnated with an arc quenching material, such as powdered silica or sand. Sand in particular is a desirable arc quenching material because it absorbs heat and turns to glass upon arcing due to the heat generated upon an opening of the fuse element. In a further arc quenching feature, in one embodiment the substrate is made of melamine, which outgases formaldehyde due to the intense heat caused by an arcing of the fuse. Formaldehyde is also helpful in quenching arcing energy. In various alternative embodiments, multiple melamine or insulative substrates may be provided, and multiple layers of conductive material may be used to configure a multi-layered fuse having a plurality insulative layers and at least one conductive layer.

The sealed nature of the fuse body of the present invention is aided by spring clips which are provided as terminals and placed about the ends of the substrate and communicate electrically with the fuse element. The substrate material or melamine may be soft and not strong under compression. The biased nature of the spring clip-like terminals and the structural integrity of the metal helps to provide support and compression resistance to the fuse. Such resistance is desirable for the fuse, which is bolted or fastened into the electrical application, such as an automotive or HEV application.

In light of the above-described features, in one embodiment, a fuse is provided and includes (i) an insulative body; (ii) a fuse element assembly held by the body, wherein the fuse element includes (a) an insulative substrate, (b) a fuse element disposed on two sides of the substrate and extending through an aperture in the substrate, the fuse element including an area configured and arranged to open upon a fuse opening event, the fuse element extending to first and second ends of the substrate, and (c) first and second terminals connected electrically to the fuse element at the first and second ends of the substrate; and (iii) an arc quenching material placed within the body and contacting at least a portion of the fuse element.

In one embodiment, the insulative substrate is made of a material selected from the group consisting of: FR-4, epoxy resin, ceramic, resin coated foil, teflon, polyimide, glass, melamine and any combination thereof.

In one embodiment, the fuse includes a top attached to the body, the top and body made of a material suitable for attachment via a process selected from the group consisting of: sonic welding, solvent bonding, adhesion and any combination thereof.

In one embodiment, the arc quenching material includes sand.

In one embodiment, the fuse element is secured to the substrate via a process selected from the group consisting of: etching and adhesion.

In one embodiment, the fuse element includes at least one heat sink portion, the heat sink portion including a expanded area of conductive material.

In one embodiment, the fuse element is made of at least one conductive material selected from the group consisting of: copper, silver, nickel, tin, gold, zinc and aluminum.

In one embodiment, the area of the fuse element configured and arranged to open upon a fuse opening event includes a reduced thickness, a reduced cross-sectional dimension or both.

In one embodiment, the area of the fuse element configured and arranged to open upon a fuse opening event includes first and second conductive materials, the second conductive material having an affinity to diffuse into and form resistive intermetallics with the first conductive material. In one embodiment, the second conductive material includes tin.

In one embodiment, the body and the substrate include at least one mated pair of fastening apertures. In one embodiment, at least one of the first and second terminals includes at least one fastening aperture configured and arranged to align with the mated pair of fastening apertures in the body and the substrate.

In one embodiment, the first and second terminals are configured and arranged to bolster the assembly's ability to withstand a compression force.

In one embodiment, at least one of the first and second terminals includes a mounting hole that mates with a mounting hole in the substrate. In one embodiment, the fuse element extends through the mounting hole in the substrate. In one embodiment, the fuse element is disposed about the mounting hole on two sides of the substrate.

In one embodiment, at least one of the first and second terminals is biased to open from the substrate.

In one embodiment, at least one of the terminals is folded over two sides of one of the ends of the substrate.

In one embodiment, the at least one of the terminals includes a flange that is abutted against an inner surface of the body.

In one embodiment, the fuse includes a top attached to the body, the top configured and arranged to compress the assembly within the body.

In one embodiment, the body includes at least one projection configured and arranged to position the assembly within the body. In one embodiment, the projection is located about a fastening hole in the body.

In one embodiment, the fuse element is disposed on two sides of the substrate.

In one embodiment, the fuse element is mirrored about two sides of the substrate.

In one embodiment, the substrate is a first substrate and which includes a second substrate, the first and second substrates sandwiching at least a portion of the fuse element.

In one embodiment, the fuse element extends inward from the first and second ends of the substrate to an aperture in the substrate, the element forming an extension through the aperture. In one embodiment, the fuse element is disposed on the sides of the substrate, the fuse element on a first side of the substrate connected electrically to the fuse element on a second side of the substrate via the extension through the aperture. In one embodiment, the fuse includes an arc quenching substance at least partially filling the aperture. In one embodiment, the arc quenching substance includes a room temperature vulcanizing ("RTV") material, such as a silicone RTV.

The present invention also provides a method of producing a fuse with high voltage capability. The method includes (i) extending a fuse element on first and second sides of an insulative substrate; and (ii) configuring the fuse element to open upon a fuse opening event at a position on the element located so that arching energy is quenched by having to travel from the first side of the substrate, through the substrate, to the second side of the substrate.

It is therefore an advantage of the present invention to provide an improved fuse.

It is another advantage of the present invention to provide a fuse suitable for use in an HEV system.

It is also an advantage of the present invention to provide a fuse that may be mechanically fastened to an electrical system.

It is a further advantage of the present invention to provide a fuse having multiple arc quenching features.

Moreover, it is an advantage of the present invention to provide a fuse that attempts to direct arcing energy to travel in multiple planes, to increase impedance across an opening in the fuse element and thereby decrease the likelihood of a sustained arc.

Additional features and advantages of the present invention are described in, and will be apparent from, the following Detailed Description of the Invention and the figures.

DETAILED DESCRIPTION

Referring now to each of the FIGS. 1 to 6, one embodiment of a high voltage/high current electric fuse of the present invention is illustrated by fuse 10. Fuse 10 is particularly well suited for a hybrid-electric vehicle ("HEV") systems. HEV systems typically use much higher voltages and currents than are normally seen in other types of automotive applications. System bus voltages for HEV systems can range from about 200 to about 600 volts DC or AC. The HEV systems are also high current systems, which can operate at around 300 amps. Fuse 10 is well suited for such voltage and current ratings because of its energy handling and arc quenching capabilities as discussed herein. While fuse 10 is well suited for HEV systems, fuse 10 is expressly not limited to such applications and is instead applicable to many high voltage and/or high current applications, such as electric vehicles, industrial applications, service entrances and localized power generation.

Figure 1:
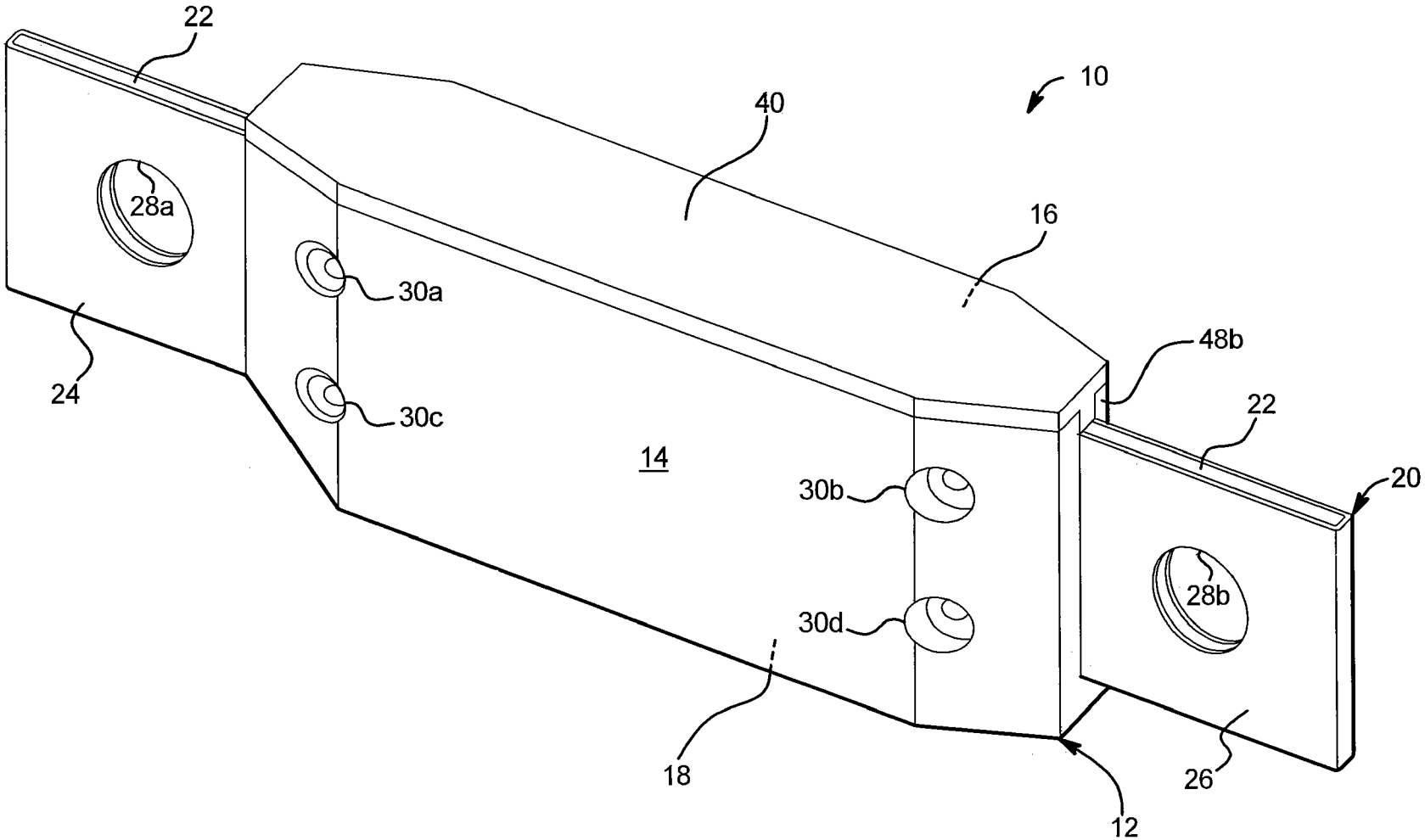
FIG. 1 is a perspective view of one embodiment of an assembled high voltage/high current fuse.
Figure 2:
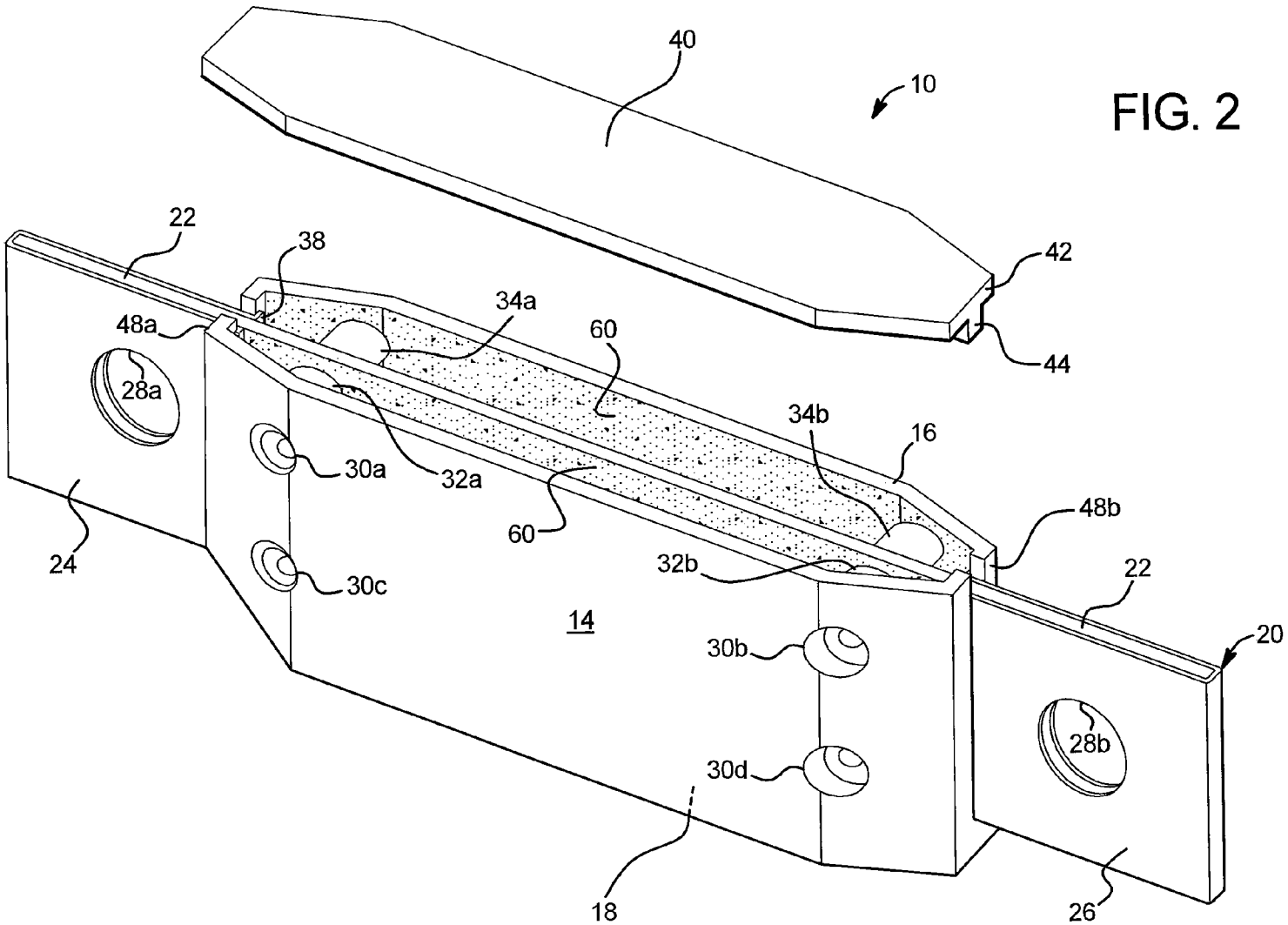
FIG. 2 is a perspective view of the embodiment of the fuse shown in FIG. 1 with a cover removed to show an inner assembly of the fuse.
Figure 3:
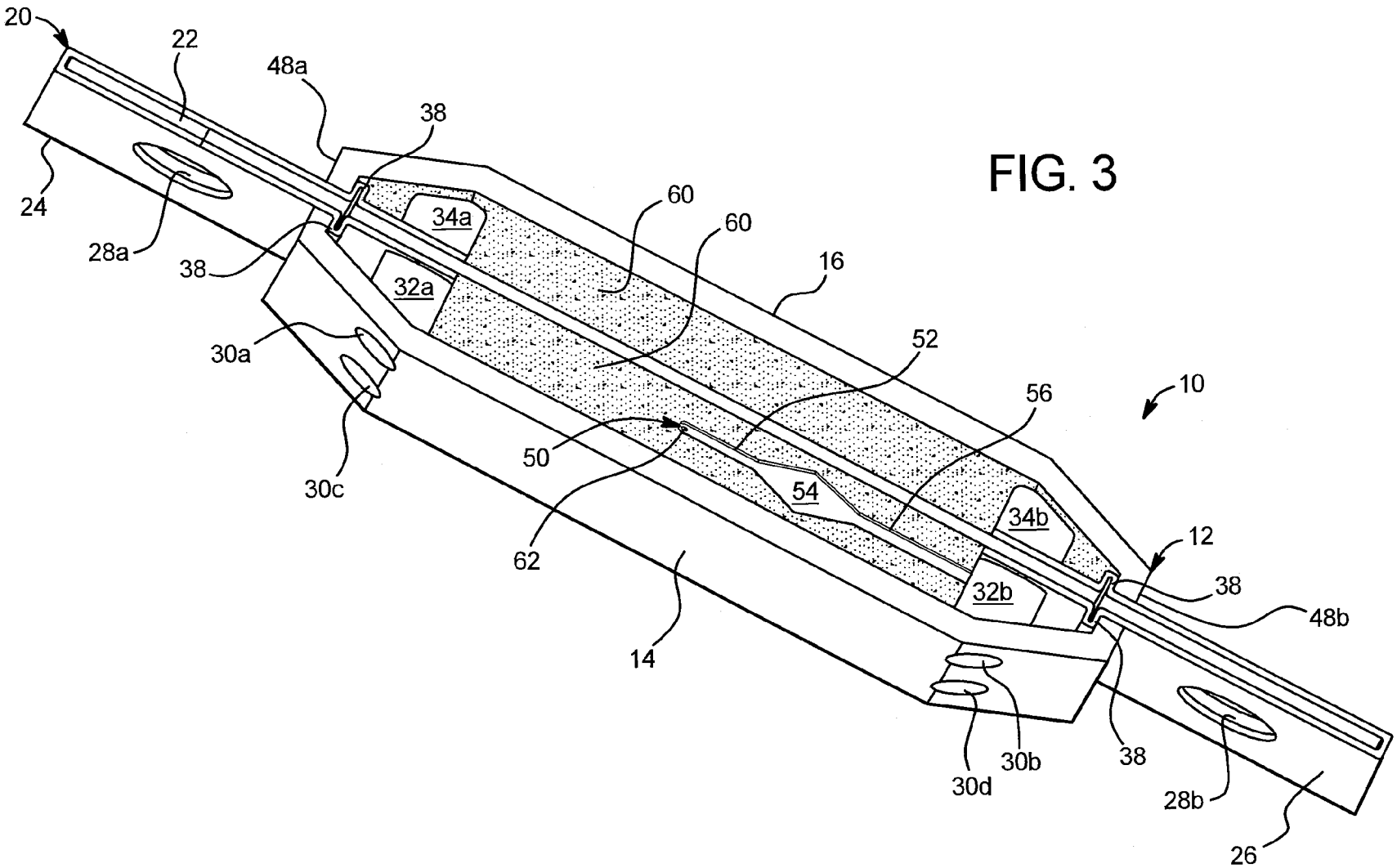
FIG. 3 is also a perspective view of another embodiment of the high voltage/high current fuse of the present invention.
Figure 4:
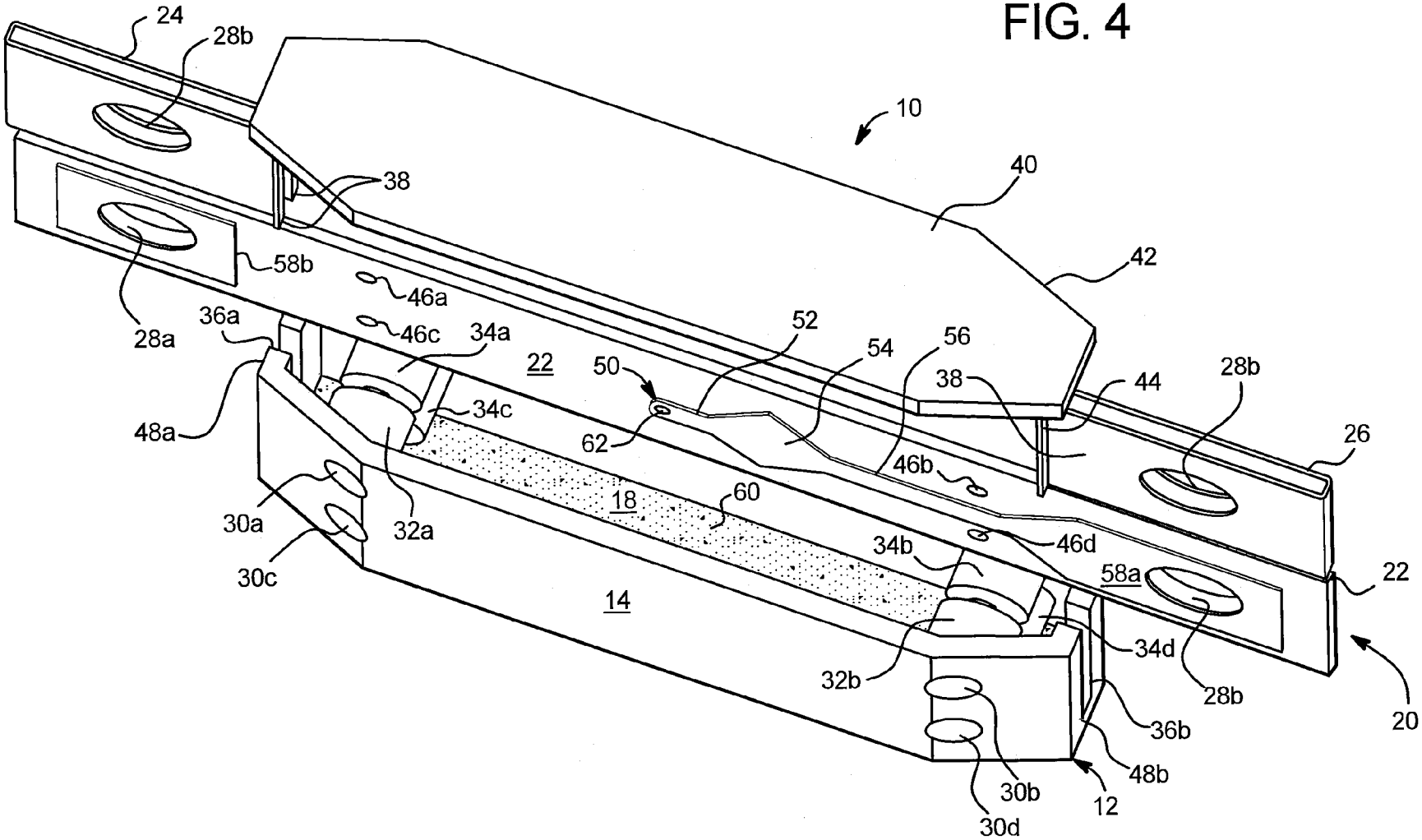
FIG. 4 is an exploded perspective view of the embodiment of the high voltage/high current fuse shown in FIG. 1.
Figure 5:
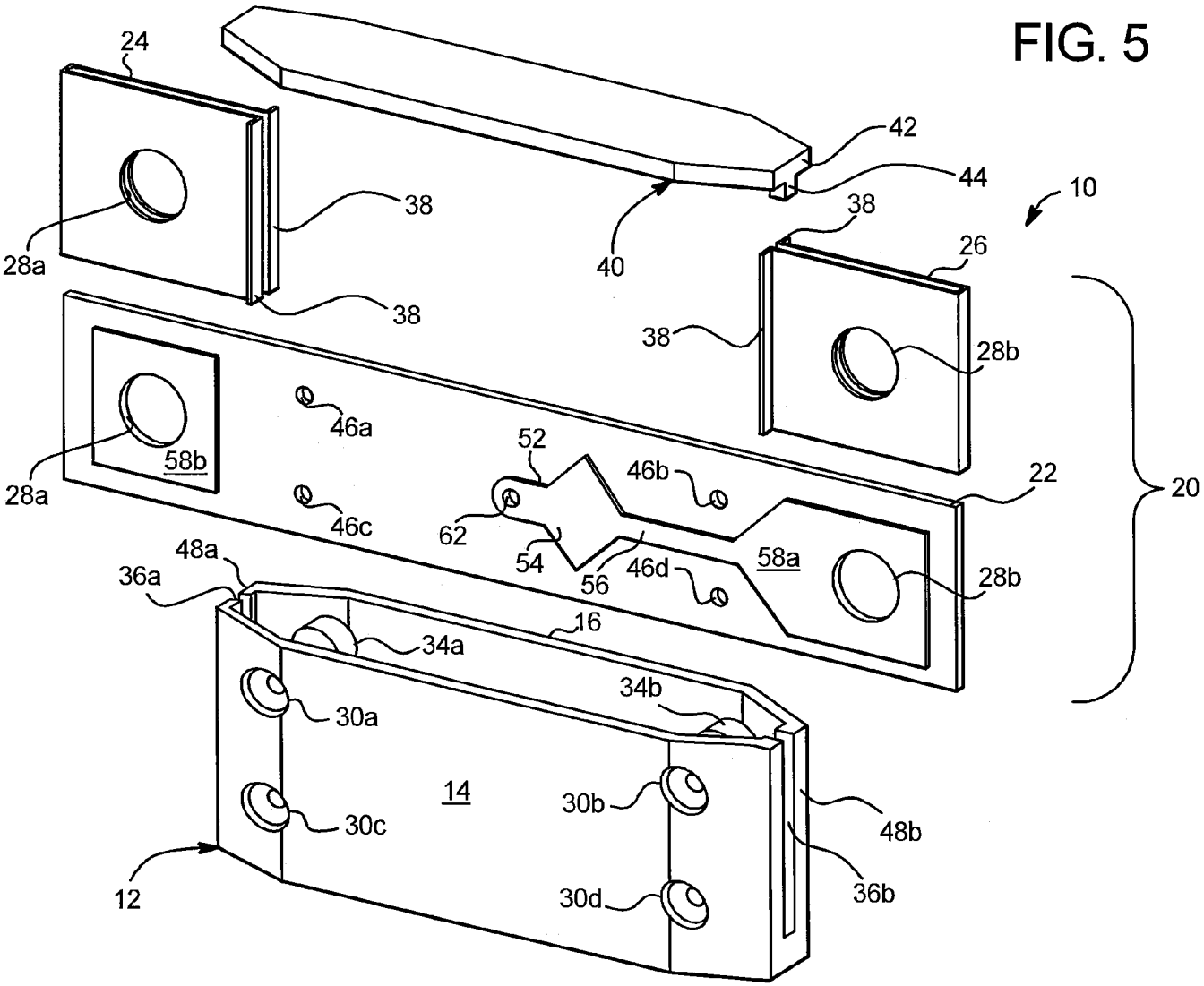
FIG. 5 is another exploded perspective view of the embodiment of the high voltage/high current fuse shown in FIG. 1.
Figure 6:
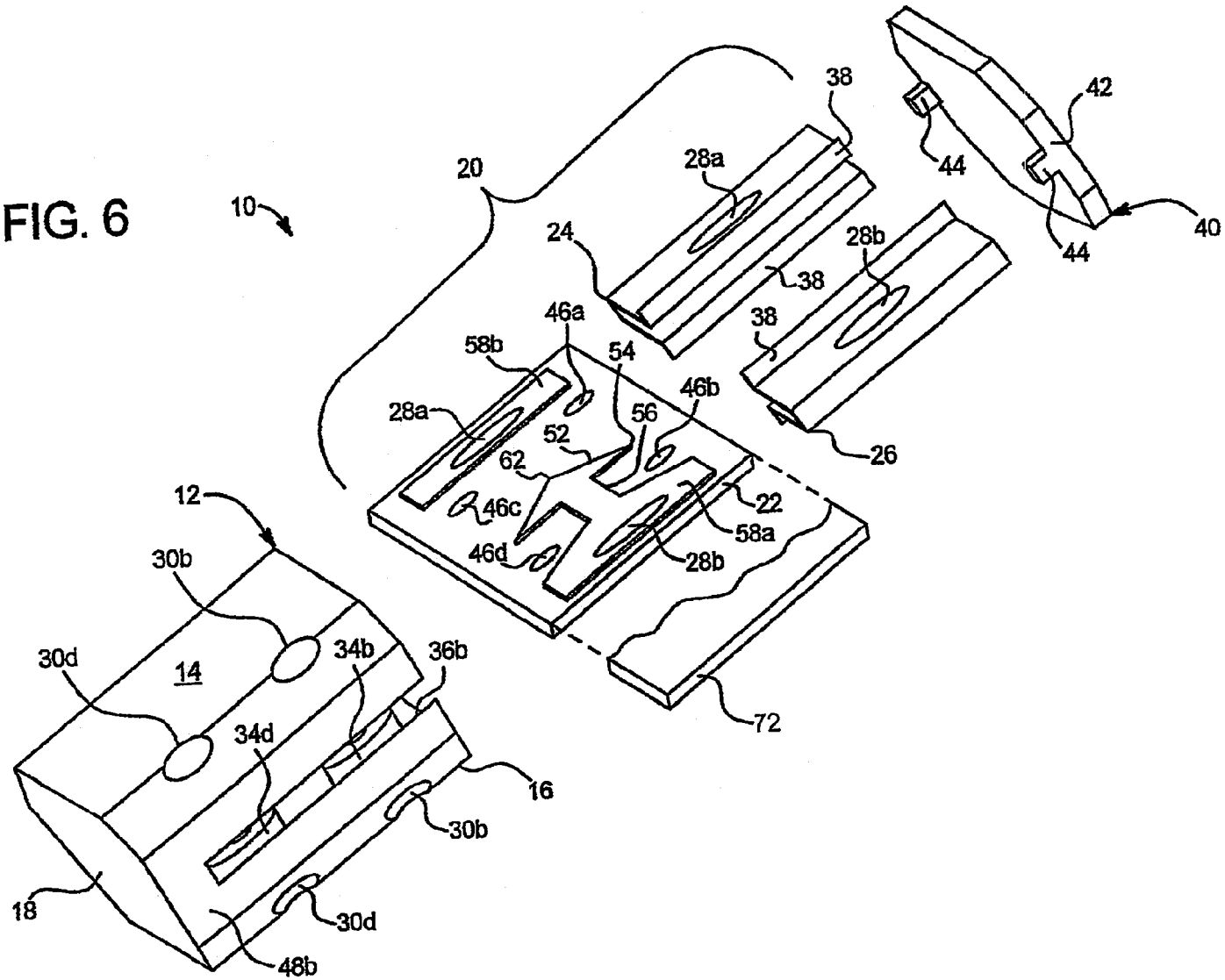
FIG. 6 is an exploded perspective view of another embodiment of the high voltage/high current fuse of the present invention.

FIGS. 1 to 3 show fuse 10 in a generally assembled state. FIGS. 4 to 6 show fuse 10 exploded so that certain components may be shown in more detail. As seen in FIGS. 1 to 6, fuse 10 includes a body 12 and a fuse element assembly 20, which is inserted into and held by body 12. Body 12 and fuse element assembly 20 can each be of any suitable size and shape. In one example, fuse element assembly 20 is substantially rectangular and has a height of about one inch (2.54 cm) and a length of about 3.5 to four inches (8.9 cm to 10.2 cm).

Fuse element assembly 20 includes an insulative substrate 22. In one example, the thickness of insulative substrate 22 can be about 0.03 inch to about 0.062 inch (0.7 mm to 1.6 mm). Body 12 is sized (length, width, height and thickness) accordingly to insulate properly a portion of fuse element assembly 20, while leaving portions of fuse assembly 20 exposed for electrical connection within an electrical system, such as an HEV system.

Body 12 includes a front wall 14, rear wall 16, bottom wall 18, and sidewalls 48*a* and 48*b*. In one embodiment, front wall 14, rear wall 16, bottom wall 18 and sidewalls 48*a* and 48*b* are formed, e.g., molded or extruded, together as an integral piece. Cover 40 is formed as a separate piece in one embodiment. In the illustrated embodiment, front wall 14 and rear wall 16 are tapered to form portions of the sides of body 12. Sides 48*a* and 48*b* of body 12 extend from the tapers of the front and rear walls 14 and 16. In an alternative embodiment, body 12 is substantially rectangular in shape, and sidewalls 48*a* and 48*b* are more pronounced. Providing a tapered or rounded shape for body 12 however may provide a shape that is better able to handle the energy released during an opening of fuse 10.

Body 12 and cover 40 may be formed from any suitable insulative or dielectric material. In one embodiment, body 12 and cover 40 are plastic, such as acrylic, delrin, kel-f, a high temperature plastic, nylon, phenolic, polyester, polyethylene, polyvinylchloride, polyvinylidene fluoride, polyphenol sulfide (Ryton™) and combinations thereof. Also, in one preferred embodiment body 12 and cover 40 are made of one or more material suitable to be fused together via ultrasonic welding, via an adhesive, solvent bonding or other similar process. Body 12 and cover 40 can be formed from the same material or be made from different materials as desired. In one preferred embodiment, body 12 and cover 40 are made from polyphenol sulfide (Ryton™).

Front wall 14 includes or defines a plurality of rivet holes 30*a* to 30*d* (referred to herein collectively as rivet holes 30 or generally as rivet hole 30). Holes 30 extend through rear wall 16 as illustrated by rivet holes 30*b* and 30*d* in rear wall 16 in FIG. 6.

In the illustrated embodiment, body 12 is formed with standoffs 32*a* to 32*d*, which surround holes 30*a* to 30*d* on front wall 14 and extend into the interior of body 12. Likewise, body 12 includes or defines standoffs 34*a* to 34*d* which surround holes 30*a* to 30*d* in rear wall 16 and extend into the interior body 12. Standoffs 32*a* to 32*d* (referred to herein collectively as standoffs 32 or generally as standoff 32) form a gap with standoffs 34*a* to 34*d* (referred to herein collectively as standoffs 34 or generally as standoff 34). The gap between standoffs 32 and standoffs 34 is sized appropriately to receive fuse element assembly 20 and hold same firmly in place. To that end, sidewalls 48*a* and 48*b* of body 12 each define an insertion notch 36*a* and 36*b* (see FIGS. 4 to 6), respectively. Insertion notches 36*a* and 36*b* are likewise sized to receive fuse element assembly 20 and hold same firmly in place.

As seen in each of FIGS. 1 to 6, terminals 24 and 26 extend outward from sides 48*a* and 48*b* of body 12. Terminals 24 and 26 in the illustrated embodiment are spring clips or otherwise folded and biased to open away from insulative substrate 22 unless otherwise held to substrate 22 via a compression force, e.g., from insertion notches 36*a* and 36*b*, via rivets or other attachment mechanism. Spring clips 24 and 26 are made of any conductive material, such as copper, silver, gold, zinc, nickel, lead, tin, aluminum or any combination thereof. In one preferred embodiment, spring clips or terminals 24 and 26 are made of copper. Copper, a good conductor, is readily formed into the desired spring clip shape and is well suited to provide the desired spring tension.

Terminals 24 and 26, substrate 22 and termination portions 58*a* and 58*b* (seen in FIGS. 4 to 6) of fuse element 50 (disposed on substrate 22) together form mounting holes 28*a* and 28*b*. Mounting holes 28*a* and 28*b* are sized to receive a bolt, screw or other type of fastener which connects fuse 10 the electrical system, e.g., an HEV system. Terminals or spring clips 24 and 26 aid assembly 20 in withstanding a compressive force due to such fastener and accompanying nut when attached to the electrical system. In particular, the material used for insulative substrate 20 may not be strong relatively under compression. The bent nature of spring clips or terminals 24 and 26 strengthens the overall assembly and aids in preventing the compressive fastening force from damaging insulative substrate 22. It should be appreciated however that the compressive fastening force does help in ensuring good electrical contact between terminals 24 and 26 and terminations 58*a* and 58*b* of fuse element 50.

As seen in FIGS. 1 and 2, body 12 and cover 40 form an enclosed encapsulated structure about a portion of assembly 20. To that end, standoffs 32 and 34 are sized to abut against substrate 20 and seal the outside of apertures 30 from the inside of body 12. Further, FIG. 2 illustrates that cover 40 includes a top 42 and projection 44. In one embodiment, projection 44 extends all the way across the length of top 42. In another embodiment (as seen best in FIG. 6), separate projections 44 are provided on each end of top 42 of cover 40. Projections 44 are fitted into the tops of insertion notches 36*a* and 36*b*. The projections compress assembly 20 against sides 48*a* and 48*b*, bottom 18 or both. Projections 44 also help to complete a sealed enclosure along sides of 48*a* and 48*b*. Projections 44 and the rest of cover 40 is fixed to body 12 via sonic welding, solvent bonding, a suitable adhesive or any combination thereof.

As seen in FIGS. 3, 4, 5 and 6, terminals or spring clips 24 and 26 are bent or otherwise formed to have flanges 38, which extend outwardly and are sized and configured to abut against an inside surface of sidewalls 48*a* and 48*b* when assembly 20 is inserted into body 12. In combination with the outward bias of clips 24 and 26, flanges 38 form a seal against such inner surfaces of sidewalls 48*a* and 48*b*. Also to that end, body 12, substrate 22 and terminals 24 and 26 are sized such that a slight tensile force is applied by substrate 22 to terminals 24 and 26 to ensure that terminals or spring clips 24 and 26 are held firm against and are at least substantially sealed to the inner surfaces of sidewalls 48*a* and 48*b*.

It is desirable to have at least a relatively sealed encasement around fuse element 50. As seen in FIGS. 2, 3 and 4, body 12 in one embodiment is filled with an insulative packing or arc quenching material 60. In one embodiment, the arc quenching material 60 is a powder or granulated material, such as sand or silica. Sand in particular is desirable because of its cost, availability and because the intense heat generated via an opening and arcing of element 50 is absorbed by the sand and by a transformation of at least a portion of the sand into glass. It should be appreciated however that other suitable packing or arc quenching materials 60 may be placed within body 12 and about the covered portion of assembly 20, such as an insulative polymer material, a ceramic material or any type of room temperature vulcanization ("RTV") material, such as silicone RTV.

It should be appreciated from the foregoing discussion that (i) standoffs 32 and 34; (ii) the flanged configuration of terminals 24 and 26; (iii) the outwardly biased nature of terminals 24 and 26; (iv) the projections 44 of cover 40 and (v) the sealed relationship between cover 40 and body 12 each contribute in providing a sealed environment in which sand 60 or other suitable arc quenching material can be loaded and held without falling through seams or apertures of body 12. Those factors also contribute in minimizing the effects of an opened fuse, at least with respect to the outside of the fuse.

In one alternative embodiment seen in FIG. 3 flanges 38 are double bent and extended further inward along substrate 22 so that the terminals 24 and 26 can be riveted or fastened together with (i) housing 12 via rivet holes 30 and (ii) substrate 22 via mating rivet apertures 46*a* to 46*d* (referred to herein collectively as rivet apertures 46 or generally as rivet aperture 46). Additional apertures or slots (not illustrated) are provided in the extended portions of terminals 24 and 26 to enable terminals 24 and 26 to be fastened or riveted to body 12 and substrate 22. Slotted apertures may be desirable to allow some play in positioning of the terminals along the longitudinal dimension of substrate 22, so that substrate 22 can pull flanges 38 of terminals 24 and 26 properly against the inner surfaces of sides 48*a* and 48*b*.

Referring mainly now to FIGS. 4 to 6, substrate 22 and fuse element 50 are discussed in more detail. Insulative substrate 22 is made of any suitable insulative material, such as FR-4, epoxy resin, ceramic, resin coated foil, teflon, polyimide, glass, melamine and suitable combination thereof. One preferred material is melamine because of its excellent arc quenching characteristics. It has been found that the extreme heat due to arcing causes melamine to outgas or thermally decompose and create formaldehyde. Formaldehyde desirably reduces the effects of arcing. The melamine material may be a B or C-stage melamine. Such material is available as white, textured semi-cured melamine formed as impregnated glass fiber weave sheets from for example Spaulding Composites, of DeKalb, Ill., and available as Part No. S-15750.

Fuse element 50 is made of any of the conductive materials listed above for terminals 24 and 26. In one preferred embodiment, fuse element 50 is made of copper, such as a copper trace disposed on a melamine or insulative substrate 22. Any suitable etching, photolithographic process for thin films deposited on the substrate, or other metallization process may be used to shape and size a desired metallic pattern on substrate 22. One suitable process for etching element 50 onto substrate 22 is described in U.S. Pat. No. 5,943,764, assigned to the Assignee of the present invention, the entire contents of which are incorporated herein by reference. Another possible way to metallize substrate 22 of fuse 10 is to adhere fuse element 50 to substrate 22. One suitable method for adhering fuse element 50 the substrate 22 is described in U.S. Pat. No. 5,977,860, assigned to the Assignee of the present invention, the entire contents of which are incorporated herein by reference.

As seen in FIGS. 4 to 6, fuse element 50 forms a desired shape or pattern on substrate 22. In one embodiment, the pattern seen on substrate 22 is mirror imaged on the opposite side of substrate 22. The fuse element 50 includes an aperture section 52, which in one embodiment is sized and shaped to open upon a fuse opening event. For example, aperture section 52 could have a reduced thickness (in a z-direction or orthogonal direction from the plane of substrate 22), a reduced cross-sectional area (in an xy-direction or planar direction with respect to substrate 22) or both. Aperture section 52 is sized so that fuse 10 opens at a desired current rating or power overload.

The portion of fuse element 50 that is designated to be portion of element 50 that opens upon a fuse opening event, e.g., portion 52 or 56, may be further metallized with a dissimilar metal, such as tin, having a lower melting temperature than the base metal, such as copper. When the tin spot heats up due to an overcurrent condition, the tin or other metal or alloy diffuses into the e.g., copper, element and forms copper-tin intermetallics. The intermetallics have significantly higher resistivities than those of copper or tin, which causes local areas of temperature rise. That point of the copper or conductive trace in turn melts before another point along the fuse element 50. In this way, the tin or low melting temperature spot helps to control and make repeatable the point at which fuse element 50 opens, especially for low overload conditions, e.g., around 135 to 150% of the rating of the fuse.

Aperture section 52 is in electrical communication with a heat sink 54. Heat sink 54 is an enlarged area of conductive material that absorbs heat from the opening of fuse element 50. Heat sink 54 communicates with a conductive extension or trace 56. In one alternative embodiment, extension 56 can be configured, e.g., reduced in thickness or cross-sectional area, to open upon a fuse opening event rather than aperture section 52. Extension section 56 in turn communicates electrically with a primary termination portion 58*a*.

In the illustrated embodiment, apertures 28*a* and 28*b* in substrate 22 are plated or otherwise metallized so that primary termination portion 58*a* communicates via such plating or metallization through aperture 28*b* to a secondary termination portion 58*b* located on the opposite side of substrate 22. Likewise, a secondary termination portion 58*b* is shown on the left hand side of substrate 22 in FIGS. 4, 5 and 6. On that left side of substrate 22, secondary termination portion 58*b* communicates electrically via a metallization or plating of aperture 28*a* with a primary termination portion 58*a* located on the opposite side of substrate 22. The primary termination portion 58*a* located on the opposite side in one embodiment is shaped, sized and configured the same as primary termination portion 58*a* seen in FIGS. 4, 5 and 6. Likewise, primary termination portion 58*a* on the opposite side of substrate 22 communicates via a like extension section 56 to a like heat sink section 54, which communicates with a like aperture section 52 located on the opposite side of substrate 22. It should be appreciated that the geometry of fuse element 50 does not have to be a mirror image on the opposing sides of substrate 22. For example, it may be desirable to provide different shapes, sizes and/or thicknesses to the fuse element portions on opposing sides of substrate 22 to produce a fuse 10 with desired time-current characteristics.

In the illustrated embodiment, an aperture or via 62 is provided in roughly the center of substrate 22. Aperture or via 62, like mounting holes 28*a* and 28*b* is plated through to connect the aperture sections 52 located on the opposing surfaces of substrate 22. In one embodiment, fuse element 50 is structured so that the element opens at or near aperture 62. This is believed to provide desirable arc quenching characteristics to the fuse 10 because the arcing energy then has to travel through substrate 22 from one side of the substrate to another. The channeling of the arc through via 62 in substrate 22 increases the impedance of the path across the opening in fuse element 50. This increase in impedance decreases a likelihood of a sustained arc.

Thus the thickness of substrate 22 and its insulative properties each contribute to the overall arc quenching abilities of fuse 50. Further, the additional arc quenching or packing material 60 provides additional arc quenching characteristics to fuse 10. Moreover, the substantially tightly sealed relationship between housing 12 and assembly 20 also helps to compress the quenching or packing material 60 against the element, which helps to dissipate arcing energy. In one embodiment, packing material or sand 60 is also disposed within aperture 62 to provide further arc quenching assistance. In an alternative embodiment, a separate RTV or other insulative material may be placed in aperture 62.

FIG. 6 illustrates an alternative embodiment of the present invention. In FIG. 6, a second or third insulative substrate 72 is laminated, adhered or otherwise secured to one or both of the sides of substrate 22. The additional one or more substrate 72 sandwiches the conductive element 50 between two thicknesses of insulative material, such as any of the materials listed above for substrate 22. In one embodiment, as above, a preferred material for additional insulative substrate 72 is melamine. Additional substrate 72 can cover a portion of or the entire element 50 as desired. In one embodiment, insulative sheet 72 covers the fuse opening portion of element 50, such as aperture 62, aperture section 52, heat sink 54 and extension section 56. Here, the additional insulative substrate 72 leaves primary and second terminations 58*a* and 58*b* of element 50 exposed, so that the terminations 58*a* and 58*b* of element 50 can communicate respectively and properly with terminals 24 and 26.

It is contemplated that additional substrates 72, may eliminate the need for the insulative packing or arc quenching material 60. It is also expressly contemplated however to provide both one or more additional insulative substrate 72 and the insulative packing material or sand 60. In one embodiment, the additional one or more insulative layer 72 includes rivet apertures, similar to apertures 46, which enable the substrate 72 to be further secured to substrate 22 and housing 12. Fuse element 50 may be located on one or both surfaces of two or more insulative layers and extend through any suitable number of vias, such as via 62. Further, any one or more surface of one or more insulative substrates may include two or more fuse elements 50 operating in parallel.

Figure 7:
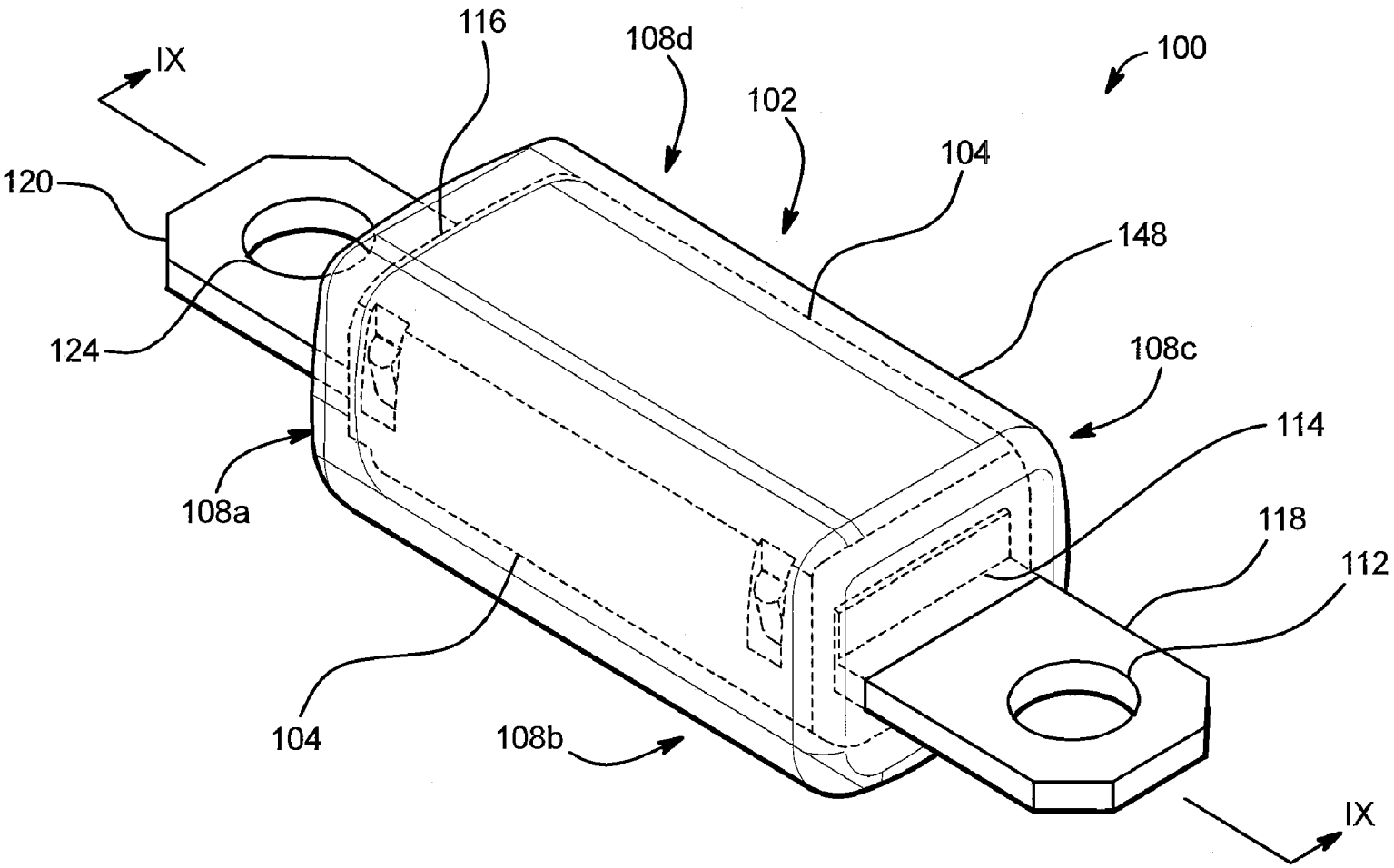
FIG. 7 is a perspective view of another embodiment of an assembled high voltage/high current fuse.
Figure 8:
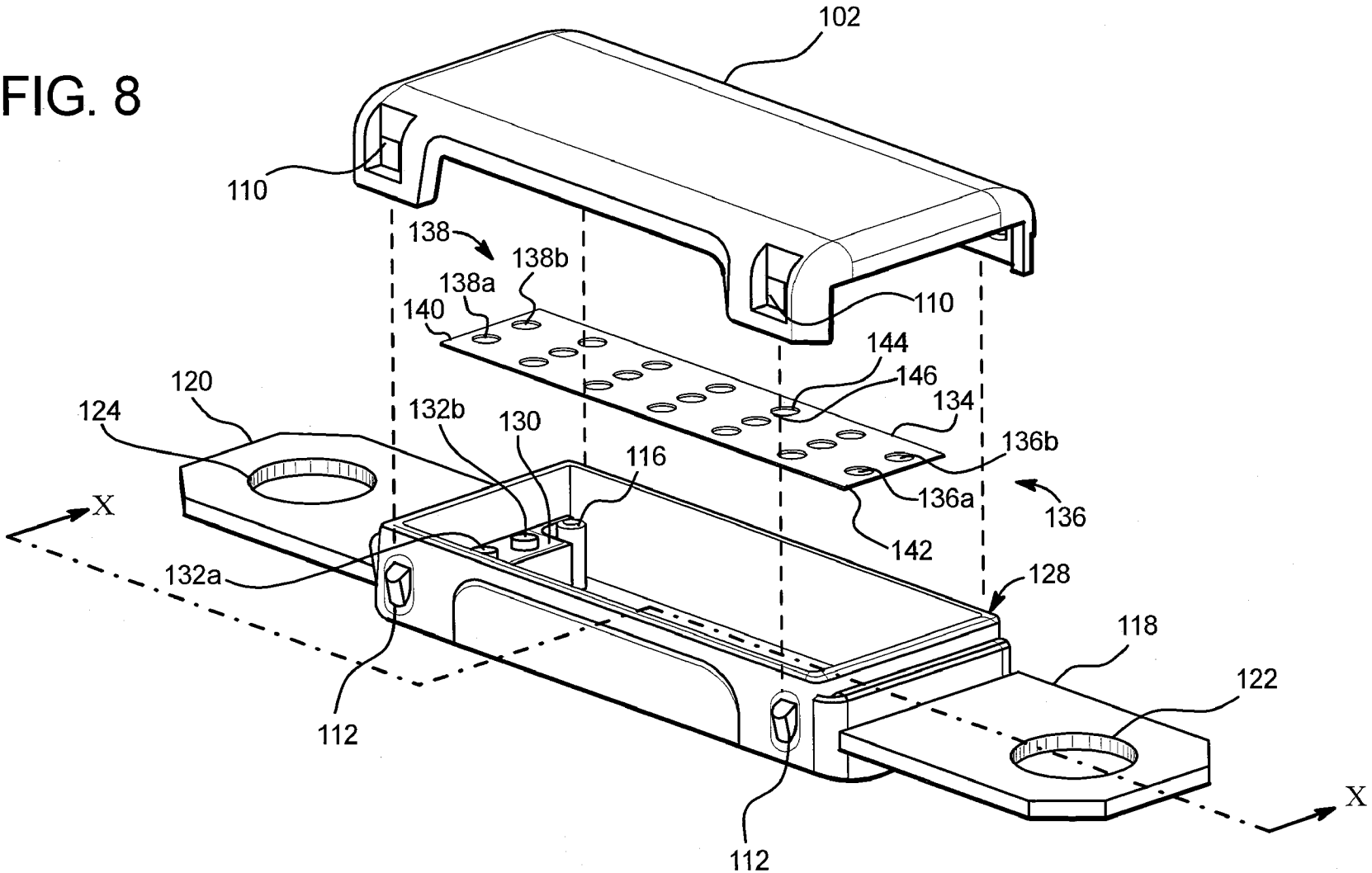
FIG. 8 is an exploded perspective view of the embodiment of the assembled high voltage/high current fuse shown in FIG. 7.
Figure 9:
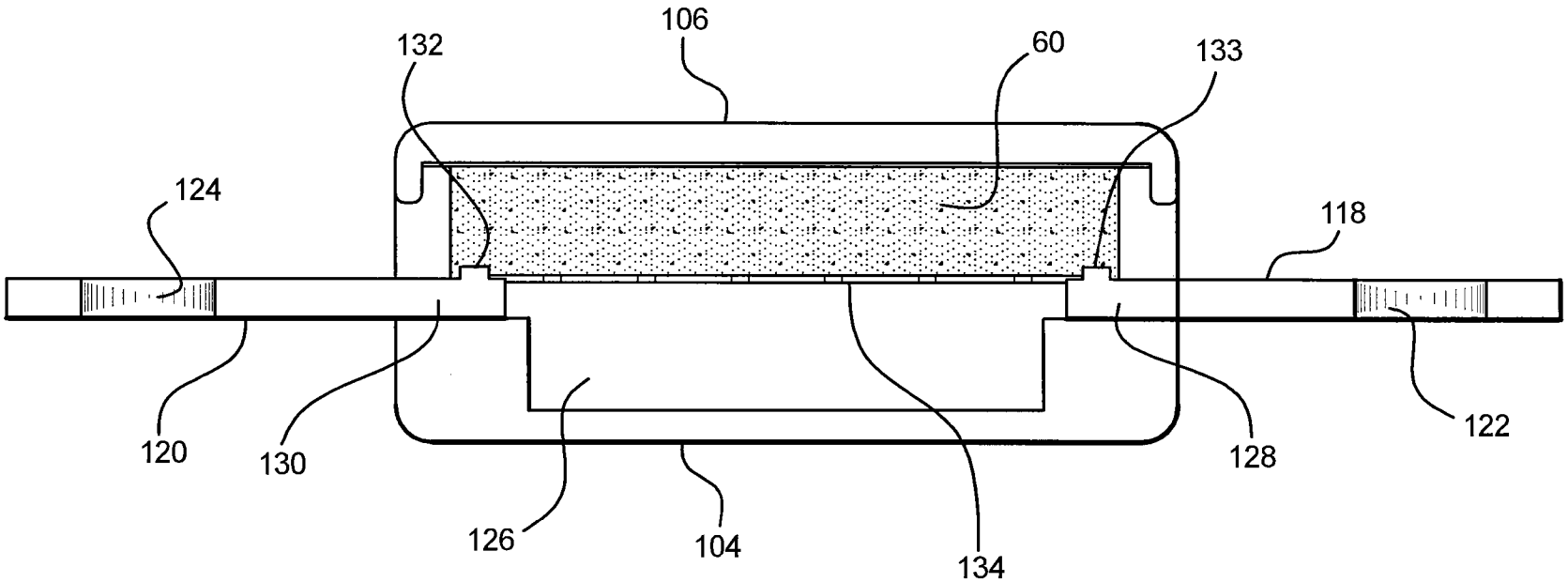
FIG. 9 is a sectional view taken along the section line IX-IX of the embodiment of the assembled high voltage/high current fuse shown in FIG. 7.

FIGS. 7, 8 and 9 illustrate another embodiment of the fuse generally indicated by the reference numeral 100. The fuse 100 includes a two-piece body 102 (simply referred to as the body 102) having a base 104 and a cover 106. The base 104 and the cover 106 are releasably engaged via detents 108 (each detent is individually identified as detent 108*a*, 108*b*, 108*c* or 108*d*). Each of the detents 108*a* to 108*d* includes a receiving portion 110 formed within the cover 106 and a retaining portion 112 formed within the base 104. In operation the base 104 and the cover 106 are arranged vertically (see FIG. 8) to align each of the receiving portion 110 with the corresponding retaining portions 112. When the base 104 and the cover 106 are brought into engagement, the retaining portions 112 releasably engage and resiliently deform relative to the receiving portions 110 in a snap-fit or locking manner. In this way, the base 104 and the cover 106 cooperate to form the body 102.

The body 102 further includes apertures 114, 116 formed by the cooperation of the base 104 and the cover 106. The apertures 114, 116 are located along the longitudinal axis of the body 102 and are sized to support terminals 118, 120. Similar to the terminals 24, 26 shown in FIG. 1, the terminals 118, 120 are substantially flat metallic or otherwise conductive elements which extend away from the body 102, and each other, along the longitudinal axis of the body 102. For example, the terminals 118, 120 may be stamped, formed or otherwise manufactured flat copper (Cu) stock into any desired terminal configuration. In one embodiment, the terminals 118, 120 are insert molded as an integral element of the base 104 to provide a tight seal and increased mechanical strength. Insert molding allows the base 104 to be molded around the terminals 118, 120 to thereby seal and contain the gases produced by the opening of the fuse element 134. The terminals 118, 120 include mounting holes 122, 124, respectively. The mounting holes 122, 124 are sized to receive a bolt, screw or other fastener allowing the fuse 100 to be connected to the electrical system of, for example, an HEV system.

FIG. 8 illustrates an exploded view of the fuse 100. The cover 106 is vertically aligned over the base 104 to expose the an open interior 126. The receiving and retaining portions 110, 112 of the detents 108 are shown as molded portions of the base 104 and cover 106, respectively. In particular, the body 102 may be molded from a variety of hard, dense materials such as, for exampled Phenolic 6401 manufactured by Phenol Inc., of Sheboygan Wis., in a variety of shapes and configurations. Alternatively, the base 104 can be manufacture or machined from a block of non-conducting material and the detents 108 or other locking mechanism may be included in a subsequent manufacturing step.

As previously discussed in connection with FIG. 7, the terminals 118, 120 extend into the interior 126 via the apertures 114, 116, respectively. A tab portion 128, 130 of the terminals 118, 120 is secured and supported adjacent to the base 104. The tab portion 130 includes a pair of studs or posts 132*a*, 132*b* extending upwards and into the interior 126. It will be understood that while the tab portion 128 is not visible due to orientation of the figure, a second pair of posts 133*a*, 133*b* (see FIG. 9) extend into the interior 126 is provided adjacent to the aperture 114.

The body 102 may further support a thin-film fuse element or fuse element 134 arranged to electrically couple the terminals 118, 120. In one embodiment, the fuse element 134 is a metallic strip or foil sized to mount within the interior 126 of the body 102. The fuse element 134 includes a first and second pair of mounting holes 136, 138 (where each individual mounting hole is identified with an a or b letter designation) sized and arranged to engage the corresponding posts formed on the terminals 118, 120. For example, in order to mount the fuse element 134 within the interior 126 of the body 102, the mounting holes 138*a*, 138*b* formed within the first end 140 of the fuse element 134 are secured around the posts 132*a*, 132*b*. Similarly, the mounting holes 136 formed within the second end 142 of the fuse element 134 are secured around the posts 133*a*, 133*b* (see FIG. 9) formed on the tab portion 128 of the terminal 118. In this manner, the fuse element 134 is supported and/or arranged to provide electrical communication between the terminals 118 and 120.

The fuse element 134 may include a plurality of voids or holes 144. The holes 144, in turn, define a number of high resistance bridges 146 arranged to open in response to sudden increases in current flowing though the fuse element 134. By changing the physical dimensions, i.e., length, width, thickness, etc., of the high resistance bridges 146 the sensitivity of the fuse element 134 to changes in electrical current, short circuits, etc., can adjusted. In other embodiments, the fuse element may be a resistance coil stretched between the posts, or an insulating substrate manufactured with electrical traces or paths arranged to electrically connect the terminals 118, 120.

Once the fuse element 134 is mounted or secured within the interior 126 of the base 104, conductive or non-conductive adhesive may be utilized to affix the mounting holes to the posts. Alternatively, the size of the mounting holes may be adjusted to provide a press fit arrangement between the fuse element 134 and the posts. In yet another alternative, the fuse element 134 can be soldered directly to the tab portions 128, 130 of the terminals 118, 120. For example, solder can be applied at the fuse element/tab portion interface and heated for form an electrical connection using a reflow oven, inductive heating, laser heating, etc. The interior 126 of the body 102 can be, in turn, filled with the quenching material 60 described above. The arc quenching material may be any insulating powder or granulated material, such as sand, silica, insulating polymers, ceramic powder or any type of room temperature vulcanization ("RTV") material, such as silicone RTV.

FIG. 9 illustrates a sectional view of the assembled fuse 100 taken along the section line IX-IX. The base 104 and the cover 106 cooperate to define the interior 126. It will be understood that the base 104 and cover 106 may be removably or permanently joined using the detents 108, adhesive, epoxy or any combinations thereof. The fuse element 134 is supported within the interior 126 by the cooperation of the mounting holes 136, 138 and the 133, 132, respectively. This arranged provides electrical communication between the terminals 118, 120 connected to the electrical system. In another alternative embodiment, the body 102 may be coated or protected with an over mold 148 (see FIG. 7). The over mold 148 can be a coating of thermoplastic such as Solvay Amodel AS-4133 HS provided Solvay Advanced Polymers, LLC of Alpharetta, Ga. The inclusion of the over mold 148 further increases the mechanical strength of the fuse 100 and seals the interior 126. The additional strength and seal of the body 104 contains the pressure generated when the fuse element 134 opens. Furthermore, the sealing provided by the over mold 148 helps to quenching material 60 to quench the arc. As the pressure in the body 104 increases, the voltage required to maintain the arc increases, therefore a tight seal is important.

Figure 10:
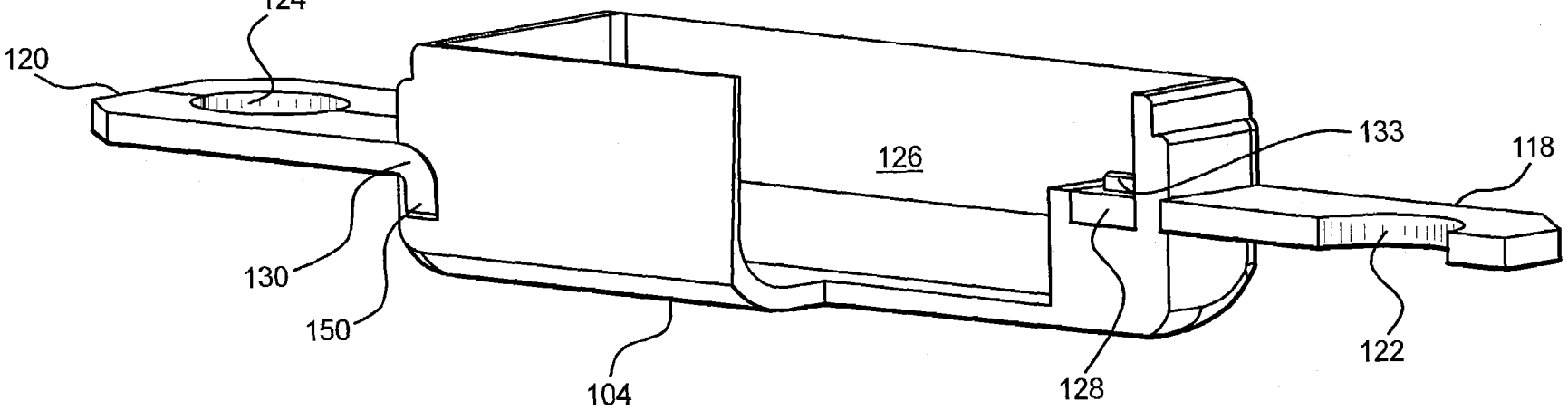
FIG. 10 is a sectional view taken along the section line X-X of the embodiment of the assembled high voltage/high current fuse shown in FIG. 7.

FIG. 10 illustrates another sectional view of the assembled fuse 100 taken along the section line X-X. In particular, the terminal 120 is shown insert molded into the base 104 to provide a secure mechanical connection between the two components. The terminal 120 includes a hook 150 configured to project into the molded base 104. The hook 150 improves the strength of the terminal base interface and increases the amount of torque that the end-user can apply to the fuse 100 in a bolting operation with out damage.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A fuse comprising:

an insulative body;

a fuse element assembly held by the insulative body, the fuse element assembly including an insulative substrate;

a fuse element disposed on two sides of the insulative substrate and extending through a hole in the insulative substrate, the fuse element including an area configured and arranged to open upon a fuse opening event, the fuse element extending to first and second ends of the insulative substrate;

first and second terminals connected electrically to the fuse element at the first and second ends of the insulative substrate wherein at least one of the first and second terminals includes a mounting hole in the terminal that mates with a mounting hole in the insulative substrate; and an arc quenching material placed within the insulative body and contacting at least a portion of the fuse element.

2. The fuse of claim 1, wherein the insulative substrate is made of a material selected from the group consisting of FR-4, epoxy resin, ceramic, resin coated foil, Teflon, polyimide, glass, melamine and any combination thereof.

3. The fuse of claim 1, which includes a top attached to the insulative body, the top and insulative body made of a material suitable for attachment via a process selected from the group consisting of sonic welding, solvent bonding, adhesion and any combination thereof.

4. The fuse of claim 1, wherein the arc quenching material includes sand.

5. The fuse of claim 1, wherein the fuse element is secured to the insulative substrate via a process selected from the group consisting of photo-etching and adhesion.

6. The fuse of claim 1, wherein the fuse element includes at least one heat sink portion, the heat sink portion including an expanded area of conductive material.

7. The fuse of claim 1, wherein the fuse element is made of at least one conductive material selected from the group consisting of copper, silver, nickel, tin, lead, zinc and aluminum.

8. The fuse of claim 1, wherein the area of the fuse element configured and arranged to open upon a fuse opening event includes a reduced thickness, a reduced cross-sectional dimension or both.

9. The fuse of claim 1, wherein the area of the fuse element configured and arranged to open upon a fuse opening event includes first and second conductive materials, the second conductive material having a lower melting temperature than the first conductive material.

10. The fuse of claim 9, wherein the second conductive material includes tin.

11. The fuse of claim 1, wherein the insulative body and the insulative substrate include at least one mated pair of fastening holes.

12. The fuse of claim 11, wherein at least one of the first and second terminals includes at least one fastening hole configured and arranged to axially align with the mated pair of fastening holes in the insulative body and the insulative substrate.

13. The fuse of claim 1, wherein the first and second terminals are configured and arranged to bolster the fuse element assembly's ability to withstand a compression force.

14. The fuse of claim 1, wherein the fuse element extends through the mounting hole in the insulative substrate.

15. The fuse of claim 1, wherein the fuse element is disposed about the mounting hole in the insulative substrate on the two sides of the insulative substrate.

16. The fuse of claim 1, wherein at least one of the first and second terminals is biased to open from the insulative substrate.

17. The fuse of claim 1, wherein at least one of the terminals is folded over two sides of one of the ends of the insulative substrate.

18. The fuse of claim 1, wherein at least one of the terminals includes a flange that is abutted against an inner surface of the insulative body.

19. The fuse of claim 1, which includes a top attached to the insulative body, the top configured and arranged to compress the fuse element assembly within the insulative body.

20. The fuse of claim 1, wherein the insulative body includes at least one projection configured and arranged to position the fuse element assembly within the insulative body.

21. The fuse of claim 20, wherein the projection is located about a fastening hole in the insulative body.

22. The fuse of claim 1, wherein the fuse element is mirrored about two sides of the insulative substrate.

23. The fuse of claim 1, wherein the insulative substrate includes a first substrate and a second substrate, the first and second substrates sandwiching at least a portion of the fuse element.

24. The fuse of claim 1, wherein the fuse element extends inward from the first and second ends of the insulative substrate to the hole in the insulative substrate, the fuse element forming an extension through the hole.

25. The fuse of claim 24, wherein the fuse element is disposed on the sides of the insulative substrate, the fuse element on a first side of the insulative substrate connected electrically to the fuse element on a second side of the insulative substrate via the extension through the hole.

26. The fuse of claim 24, which includes the arc quenching material at least partially filling the aperture.

27. The fuse of claim 24, wherein the arc quenching material includes a room temperature vulcanizing ("RTV") material.

28. A fuse comprising:

an insulative body;

a fuse element assembly held by the insulative body, the fuse element assembly including an insulative substrate;

a fuse element disposed on two sides of the insulative substrate and extending through a hole in the insulative substrate, the fuse element including an area configured and arranged to open upon a fuse opening event, the fuse element extending to first and second ends of the insulative substrate;

first and second terminals connected electrically to the fuse element at the first and second ends of the insulative substrate wherein at least one of the terminals is folded over two sides of one of the ends of the insulative substrate; and an arc quenching material placed within the insulative body and contacting at least a portion of the fuse element.

29. A fuse comprising:

an insulative body;

a fuse element assembly held by the insulative body, the fuse element assembly including an insulative substrate, said insulative substrate includes a first substrate and a second substrate, the first and second substrates sandwiching at least a portion of the fuse element;

a fuse element disposed on two sides of the insulative substrate and extending through a hole in the insulative substrate, the fuse element including an area configured and arranged to open upon a fuse opening event, the fuse element extending to first and second ends of the insulative substrate;

first and second terminals connected electrically to the fuse element at the first and second ends of the insulative substrate; and an arc quenching material placed within the insulative body and contacting at least a portion of the fuse element.

* * * * *